US006039469A

United States Patent [19]

Palmer

[11] Patent Number: 6,039,469

[45] Date of Patent: Mar. 21, 2000

[54] MIXING KNEADER

[75] Inventor: David Palmer, Groton, Mass.

[73] Assignee: List AG, Arisdorf, Switzerland

[21] Appl. No.: 09/051,244

[22] PCT Filed: Sep. 23, 1996

[86] PCT No.: PCT/EP96/04145

§ 371 Date: May 29, 1998

§ 102(e) Date: May 29, 1998

[87] PCT Pub. No.: WO97/12666

PCT Pub. Date: Apr. 10, 1997

[30] Foreign Application Priority Data

Oct. 4, 1995 [DE] Germany ..... 195 36 944

[51] Int. Cl.[7] ..... B01F 7/04

[52] U.S. Cl. ..... 366/97; 366/301; 366/313

[58] Field of Search ..... 366/97, 297, 299, 366/300, 301, 309, 312, 313

[56] References Cited

U.S. PATENT DOCUMENTS

| | | | |
|---|---|---|---|
| 3,687,422 | 8/1972 | List | 366/309 |
| 3,689,035 | 9/1972 | List | 366/309 |
| 3,880,407 | 4/1975 | List | 366/309 |
| 4,775,243 | 10/1988 | Baumgartner | 366/313 |
| 4,826,324 | 5/1989 | Kunz et al. | 366/309 |
| 4,941,130 | 7/1990 | List et al. | 366/313 |
| 4,950,081 | 8/1990 | List | 366/313 |
| 5,334,358 | 8/1994 | Schuchardt et al. | 366/301 |
| 5,407,266 | 4/1995 | Dotsch et al. | 366/97 |

FOREIGN PATENT DOCUMENTS 63-232828 9/1988 Japan .

*Primary Examiner*—Tony G. Soohoo

*Attorney, Agent, or Firm*—Bachman & LaPointe, P.C.

[57] ABSTRACT

A kneader mixer comprises at least two axial-parallel rotating shafts, each of the shafts having a plurality of kneading-transporting elements axially spaced on the shaft and separated from each other on the shaft by a tubular section.

5 Claims, 4 Drawing Sheets

MIXING KNEADER

BACKGROUND OF THE INVENTION

The present invention relates to a kneader-mixer for the carrying out of mechanical, chemical and/or thermal processes which has at least two axial-parallel rotating shafts on each of which there are at least kneading and transport elements succeeding each other in the direction of rotation of the shafts, kneading and transport elements following each other in the axial direction of the corresponding shaft which contains a gap with respect to each other through which some of the kneading and transport element pass on the other shaft in each case.

Products must be treated today in many fields of industry, particularly however in the chemical industry. For example, in the kneader-mixer described above, two chemical products must be so intimately mixed together that they at least partially react. In this case, these products may pass through any desired aggregate state so that the requirements made on the kneader-mixer are very high.

In essence, a distinction is made between single-shaft and double-shaft kneader-mixers. The present invention concerns a multi-spindle kneader and mixing machine such as described, for instance, in CH-A 506 322. In that case, radial disk elements are present on a shaft, and axially directed kneading bars arranged between the disks. Kneading elements developed in frame shape engage between these disks from the other shaft. These kneading elements clean the disks and kneading bars of the first shaft. The kneading bars on both shafts, in their turn, clean the inner wall of the housing.

Further embodiments of multi-shaft kneader-mixers are described in EP 92 10 88 29.0.

In all of these multiple-spindle mixers and kneader-mixers it is a question, above all, of freeing all surfaces which come into contact with the product to be treated, and in particular, with the heated surfaces, from product encrustations or attachments. In the above-mentioned European Patent Application 92 10 88 29.0, this is done already to a substantial extent; to be sure, due to the gap between the kneading and transport elements, a ring which is not cleaned always remains on the inner wall of the housing both on the agitator shaft and on the cleaning shaft.

The object of the present invention is to create a possibility for also eliminating this ring.

SUMMARY OF THE INVENTION

In order to achieve this object, the kneading and transport elements succeeding each other in the direction of rotation of the shaft are arranged at least partially axially staggered.

This means that the actual kneading and transport elements for each shaft clean the corresponding housing inner wall 100%. This has advantages both for the heat transfer and for the product transport.

When mention is made in the present case of kneading and transport elements, these elements have not only the kneading and transport function, but also the above-mentioned cleaning function.

A kneading and transport element preferably consists of a radial carrier element and a kneading bar placed on the circumference of the carrying element. In this connection, there is the possibility of equipping both the radial transport element and the kneading bar in any way desired. The kneading bar can be developed in cross section in the manner of a plowshare or be provided with lateral wings.

The carrying element can be segmental, disk-shaped, wrench-shaped, sawtooth-shaped, shaft-shaped or developed merely as strips. Here, many possibilities are conceivable and lie within the scope of the present invention. It is merely essential that between the kneading elements and transport elements and here, in particular, between the kneading bars which axially are adjacent each other, a gap is present through which some of the kneading and transport elements pass on the other shaft. By the axial stagger of the kneading bars from kneading and transport elements following each other in the direction of rotation, assurance is had that this gap is continuously cleaned.

The kneading and transport element can be placed in any desired manner on the corresponding shaft and connected with it. To be sure, these kneading and transport elements must take up considerable forces, so that it has been found favorable for them to be integrated into the shaft. In this connection it is possible to produce the radial carrier elements together with a ring so that this manufacturing process is considerably simplified. Furthermore, there is less danger of the breaking of the radial carrier element in the case of a one-piece manufacture. The kneading bars are then preferably welded onto the radial carrier elements.

If the connection with a ring is selected for the kneading and transport elements, the entire shaft can be developed in sections. This means that the shaft consists essentially of individual tubular sections between which the rings are arranged. Two adjacent rings can then possibly be separated by an intermediate ring so that in this way the axial stagger of the kneading bars is determined. This axial stagger should in any event be so great that it covers the gap between the two kneading bars preceding each other in direction of rotation.

In any event, assurance must be had that in all cases those same kneading and transport elements as have the same axial stagger cooperate with each, i.e. mesh with each other. Only in this way is the result obtained that the two kneading bars having a different offset do not strike against and damage each other.

In order to achieve this goal, it is necessary to adapt the number and shape of the kneading and transport elements, the speed ratio of the shafts, and the direction of rotation of the shafts to each other. It is possible to operate the shafts both in the same direction and in opposite direction. The speed ratio of the shaft is preferably directly proportional to the ratio of the kneading/transport bars on the shafts. Furthermore, the number of bars should be so determined that upon each revolution of the shaft, the same shaft transport bars are in engagement with each other.

As a whole, by the present invention there is created a multiple-spindle kneader-mixer in which both housing inner walls are completely cleaned. This constitutes the essential advantage of the present invention, the expense for this conversion being very slight.

BRIEF DESCRIPTION OF THE DRAWINGS

Further advantages, features and details of the invention will be evident from the following description of preferred embodiments and by reference to the drawing, in which.

DETAILED DESCRIPTION

Figure 1:
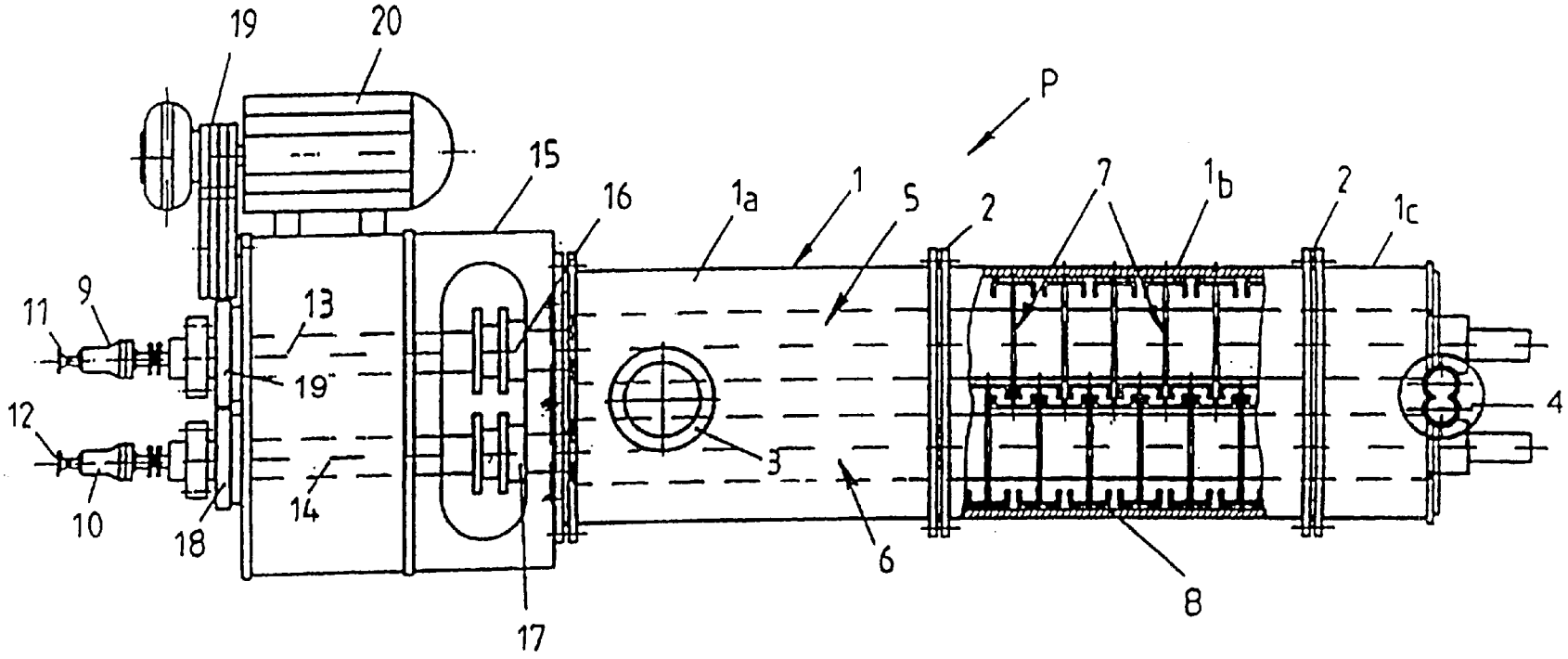
FIG. 1 is a top view of a kneader-mixer of the invention, with the housing partially cut away.

A kneader-mixer P has, according to FIG. 1, a housing which consists of several housing sections 1*a*, 1*b* and 1*c*. The housing sections are coupled to each other by corresponding flange connections 2. Within the housing section 1*a*, there is a feed pipe 3 for a product to be treated within the kneader-mixer and in the housing section 1*c* there is provided an outlet connection 4 for the treated product.

The product is transported from the feeding connection 3 to the outlet connection 4 by means of two shafts 5 and 6 as well as kneading and transport elements 7 arranged thereon. During the transport, a mixing and kneading of the product as well as preferably a thermal treatment takes place. For this purpose, the shafts 5 and 6 and possibly also the kneading and transport elements 7 as well as (not shown in detail) the housing wall 8 are heated. For the introduction of a heating fluid into the shafts 5 and 6 and from there possibly into the inside of the kneading and transport elements 7, connections 9 and 10 are arranged around corresponding inlet and outlet nipples 11 and 12 for the heating fluid conducted through the shafts 5 and 6. A corresponding guidance of the heating fluid in jacket surfaces of the shafts 5 and 6 and a corresponding return through outlet nipple 12 are covered by the prior art and are therefore not further described.

Between the connections 9 and 10 journal pins 13 and 14 connected with the shafts 4 and 5 engage through a spacer 15 a stuffing box 16 and 17 against the housing 1 being provided in each case to seal off the shaft 5 or 6. The journal pins 13 and 14 are coupled with each other outside the spacers via corresponding transmission elements 18 and 19, for instance gear wheels, the transmission element 19 being connected via the gearing 20 with a drive 21. Via this drive 21 and the transmission 20, the transmission element 19 is first of all placed in rotation, which rotation is transmitted to the shaft 5. A transmission of this rotary movement to the transmission element 19 can take place in the same or opposite direction and with the same or different speed of rotation. Corresponding stepped-down gearings are commercial and will not be described in detail here.

Figure 2:
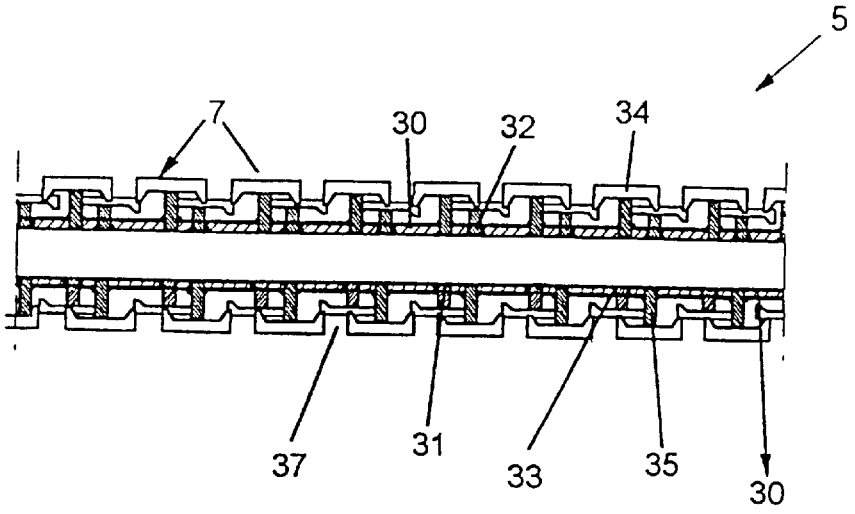
FIG. 2 is a longitudinal section through an agitator shaft in accordance with the invention.

In FIG. 2 it can be noted that at least a part of the agitator shaft 5 is assembled of a plurality of pipe sections 30 which receive between each other, at least in each case, two rings 31 and 32 which in this case are connected to each other via corresponding welds 33 and to the pipe sections 30. On the rings 31 and 32 there are arranged the kneading and transport elements 7 which in each case consist essentially of a kneading bar 34 and a radial carrying element 35. Particularly in FIG. 7, it can be noted that the ring 31/32 and the radial carrying element 35 may be made in one piece while the kneading bar 34 is placed on the radial carrying element 35. The radial carrying element 35 can furthermore be developed in any manner desired. In the present embodiment, it is of strip shape. However, it can also be disk-shaped, serrated, undulated, annular, segmental or the like. Only by way of example reference is had to Swiss Patent Applications 00551/88-0, 00550/88-8, European Patent Applications 90 11 86 26.2, 91 10 54 97.1, or DE-OS 41 18 884.5.

It is essential in the present invention that the rings 31 and 32 follow each other axially so that the corresponding kneading and transport elements 7 are arranged axially offset. In this way, an axial stagger of the kneading bars 34 also takes place, as can be noted from FIG. 3. On each ring 31 or 32, there are, in accordance with FIG. 3, in each case 4 kneading and transport elements 7, these kneading and transport elements 7 varying in their axial stagger.

Figure 3:
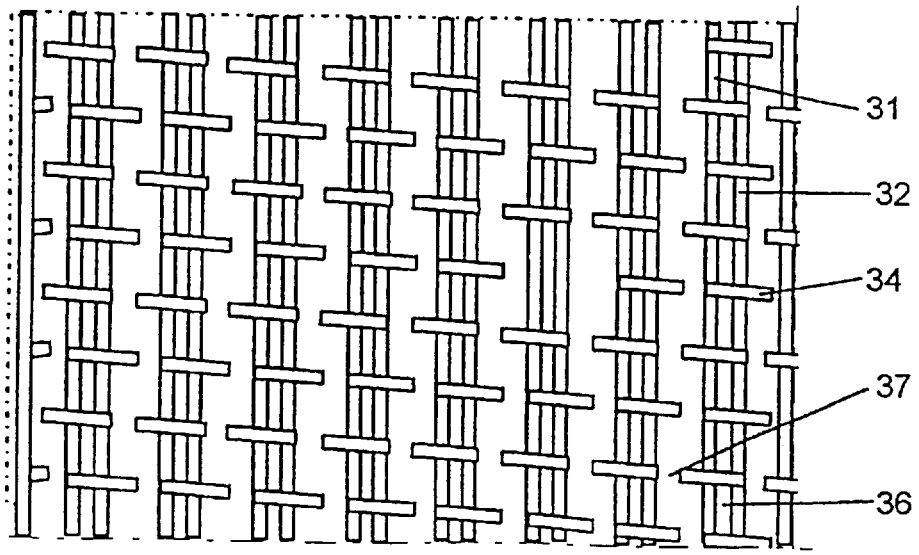
FIG. 3 is a developed view of the agitator shaft of FIG. 2.

From FIG. 3 it can also be noted that, between the ring 31 and the ring 32, there is also an intermediate ring 36 which spaces the rings 31 and 32 so far apart that a gap 37 between two axial successive kneading bars 31 is bridged over by the following kneading bar in direction of rotation.

Figure 4:
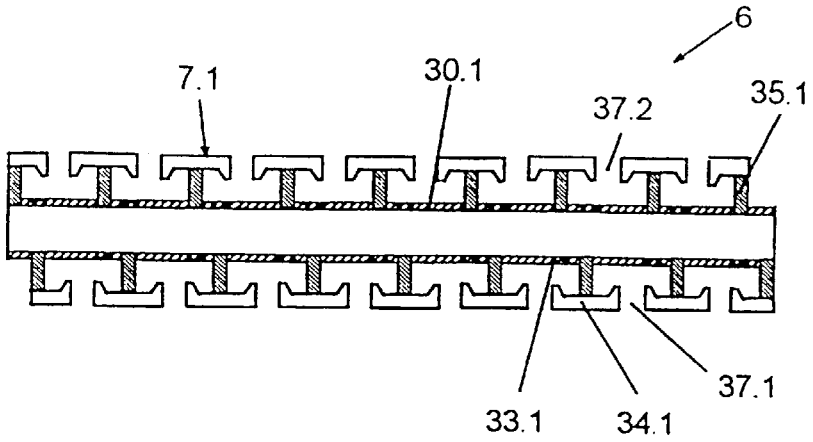
FIG. 4 is a longitudinal section through a cleaning shaft in accordance with the invention.
Figure 5:
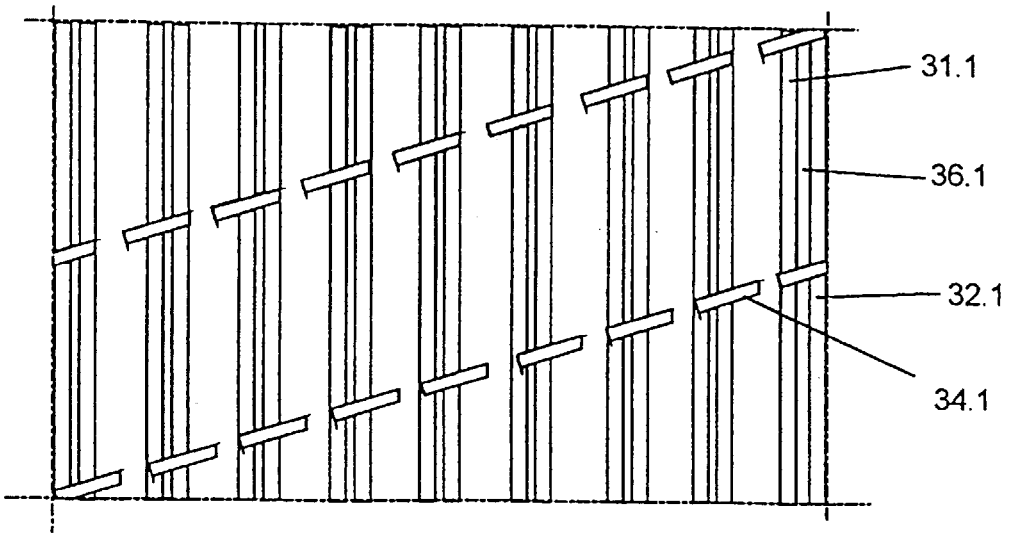
FIG. 5 is a developed view of the cleaning shaft of FIG. 4.

The cleaning shaft 6 in accordance with FIGS. 4 and 5 is also composed of pipe sections 30.1, in which connection two pipe sections 30.1 which follow each other in axial direction of the cleaning shaft receive between each other two rings 31.1 and 32.1 as well as possibly an intermediate ring 36.1. In this case also the pipe sections 30.1, the rings 31.1 and 32.1, and the intermediate rings 36.1 are connected to each other by corresponding welds 33.1.

On each ring 31.1 and 32.1 there is at least one kneading and transport element 7.1 which also consists of a radial carrying element 35.1 and a kneading bar 34.1 placed thereon. The kneading bars 34.1 or radial carrying elements 35.1 of two corresponding rings 31.1 and 32.1 are again arranged staggered in axial direction so that gaps 37.1 and 37.2 are also axially staggered.

Figure 6:
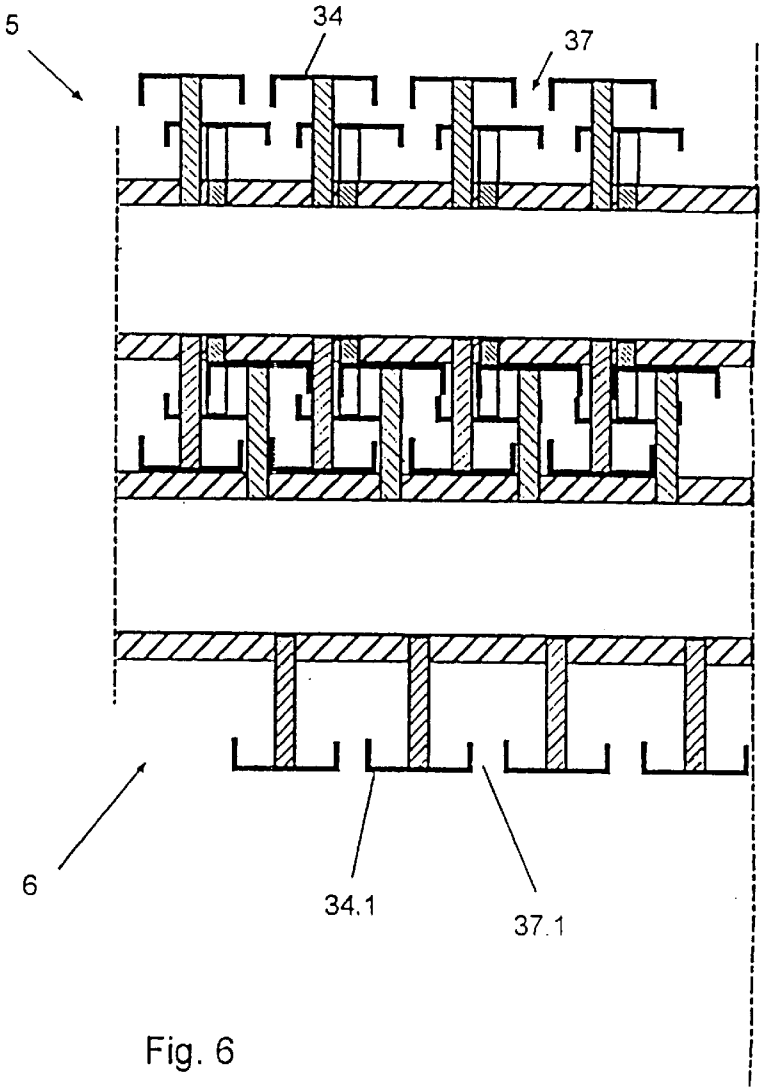
FIG. 6 is a diagrammatic view of a part of agitator shaft and cleaning shaft in position of use.
Figure 7:
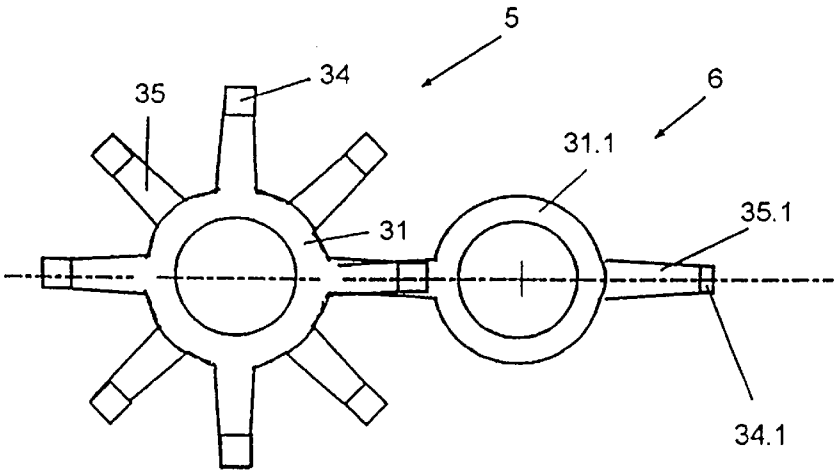
FIG. 7 is a front view of the position of use of agitator and cleaning shaft of FIG. 6.

The manner of operation of the present invention will be explained in particular with reference to FIGS. 6 and 7. The kneading and transport elements 7 and the kneading and transport elements 7.1 of the agitating and cleaning shafts 5 and 6 engage in fork shape upon rotation in each other. In this connection, the speed of rotation is so adjusted that in each case those rotary and transport elements 7 and 7.1 which follow each other in the direction of rotation in an axially offset plane engage with each other. In this way, assurance is had that all gaps 37, 37.1 and 37.2 are passed over by the corresponding kneading bars 34 and 34.1 so that no ring can build up here on a housing intermediate wall or form an annular torus. In this connection, to be sure, the ratio of the number of kneading and transport elements on the agitator shaft to the kneading and transport elements 7.1 on the cleaning shaft is to be noted. Furthermore, the speed of the agitating and cleaning shafts 5 and 6 is also to be adapted to this. If there are the same number of kneading and transport elements 7 and 7.1 on the agitating and cleaning shafts 5 and 6, then both shafts are preferably operated with the same speed. Insofar as only a smaller number of kneading and transport elements 7 are present on the agitator shaft (for instance 2 or 4), the cleaning shaft 6 can also be operated with a higher speed. It must merely be seen to it that the kneading and transport elements 7 and 7.1 which are arranged staggered in a plane always cooperate with each other.

The ratio of the number of kneading and transport elements 7 to the kneading and transport elements 7.1 on the cleaning shaft 6 is as a rule a whole integer, but a ratio of 6:4 is also possible for instance.

Furthermore, this arrangement is also possible both with the same direction of rotation of the two shafts 5 and 6 and with opposite direction. Direction of rotation, speed of the shafts, and number of the kneading and transport elements should be adapted to the specific product which is being processed by the kneader-mixer. The same applies also to the development of the radial carrier elements 35 and 35.1 by the enlargement of which, for instance, the dwell time of the

I claim:

1. A kneader for kneading and transporting a product through the mixture comprising:

a housing having a product inlet and a product outlet; and a pair of coaxial shafts rotatably mounted in the housing for transporting the product from the product inlet to the product outlet, each of the pair of coaxial shafts includes a plurality of elements mounted thereon for kneading and transporting the product wherein the plurality of elements on each coaxial shaft are actually spaced thereon to provide a gap therebetween which receives a portion of an element on the other coaxial shaft wherein each element includes a radial carrying element connected to a ring carried on a corresponding coaxial shaft wherein adjacent rings on the coaxial shaft are separated from each other by a tubular section.

2. A kneader-mixer according to claim 1, wherein each element consists of a radial carrying element and a kneading bar placed on the circumference of the carrying element.

3. A kneader-mixer according to claim 2, wherein the radial carrying element is connected with a ring which is integrated in the shaft.

4. A kneader-mixer according to claim 3, wherein adjacent rings of adjacent elements are separated by an intermediate ring.

5. A kneader-mixer according to claim 1, further including control means for rotating the coaxial shafts at a desired speed of rotation and in a desired direction of rotation wherein the number of elements, the speed of rotation of the shafts, and the direction of rotation of the shafts are controlled so that the elements have the same axial stagger so as to always cooperate with each other.

* * * * *